US007421194B2

(12) United States Patent
Lin

(10) Patent No.: US 7,421,194 B2
(45) Date of Patent: Sep. 2, 2008

(54) QUARTZ HEATER TUBE MODULE

(76) Inventor: Cheng Ping Lin, 5th Fl., No. 26, Sec. 3, Ren-ai Rd., Taipei (TW)

( * ) Notice: Subject to any disclaimer, the term of this patent is extended or adjusted under 35 U.S.C. 154(b) by 79 days.

(21) Appl. No.: 11/435,137

(22) Filed: May 17, 2006

(65) Prior Publication Data

US 2007/0062931 A1 Mar. 22, 2007

(30) Foreign Application Priority Data

Sep. 9, 2005 (TW) ..... 94215496 U

(51) Int. Cl.
*F26B 3/30* (2006.01)

(52) U.S. Cl. ..... 392/411; 219/481

(58) Field of Classification Search ..... None
See application file for complete search history.

(56) References Cited

U.S. PATENT DOCUMENTS 4,180,723 A * 12/1979 Szupillo ..... 219/541
6,376,816 B2 * 4/2002 Cooper et al. ..... 219/543
7,003,220 B2 * 2/2006 Gerhardinger ..... 392/483
7,081,602 B1 * 7/2006 Black ..... 219/523
7,123,825 B2 * 10/2006 Abbott ..... 392/466
7,206,506 B2 * 4/2007 Sturm ..... 392/478
2003/0077078 A1 * 4/2003 Wu ..... 392/440

* cited by examiner

*Primary Examiner*—Thor S Campbell
(74) *Attorney, Agent, or Firm*—Lowe Hauptman Ham & Berner, LLP

(57) ABSTRACT

Disclosed is a quartz heater tube module in which the individual quartz heater tube proper has a first and a second coverings covered on the outer surface of the glass tube. The first covering is provided with a first electrode in electrical connection with an electrode of the quartz heater tube proper; and the second covering is provided with a second electrode in electrical connection with the other electrode of the quartz heater tube proper. In this manner, the quartz heater tube proper is securely protected by the aforesaid two coverings from breaking with an external impact. A plurality of tube propers can be connected in series or parallel by adaptive sleeves so as to form an impact resistant quartz heater tube module.

5 Claims, 4 Drawing Sheets

QUARTZ HEATER TUBE MODULE

BACKGROUND OF THE INVENTION

1. Field of the Invention

The present invention relates to a quartz heater tube module. In particular, a plurality of quartz heater tubes combined to form a quartz heater tube module so as to facilitate assembling and testing.

2. Description of the Prior Art

The heating device such as a conventional electric water heater, one or several quartz heater tube is associated with a water supply pipe so as to heat up the water flowing in the water supply pipe thereby the water heated to a required temperature can be obtained.

However, the quartz heater tube is easy to break by impact as it is formed of fragile glass so that it is difficult to pass the test as a qualified safety product. It is difficult to group a plurality of quartz heater tubes to form into a module by reason of its slippery glass surface.

It is what the reason the inventor of the present invention has endeavored for years by continuous research and experimentation attempting to find out the remedy to rectify the inherent short-comings of the conventional quartz heater tubes described above, and at last has succeeded in coming up with the present invention.

SUMMARY OF THE INVENTION

Accordingly, the main object of the present invention is to provide a quartz heater tube module in which a plurality of quartz heater tubes are combined in a unit with proper means easy for assembly and production test.

To achieve the above object, the individual quartz heater tube proper in the module has a first and a second coverings covered on the outer surface of the glass tube. The first covering is provided with a first electrode in electrical connection with an electrode of the quartz heater tube proper; and the second covering is provided with a second electrode in electrical connection with the other electrode of the quartz heater tube proper. In this manner, the quartz heater tube proper is securely protected by the aforesaid two coverings from breaking caused by an external impact force. Furthermore, a plurality of quartz heater tube propers can be connected in series or parallel by adaptive sleeves bridging across the end terminals of the adjacent tube propers so as to form an impact resistant module qualified for the production test.

BRIEF DESCRIPTION OF THE DRAWINGS

The above object and other advantages of the present invention will become more apparent by describing in detail the preferred embodiment of the invention with reference to the appended drawings below.

DETAILED DESCRIPTION OF THE PREFERRED EMBODIMENTS

Figure 1:
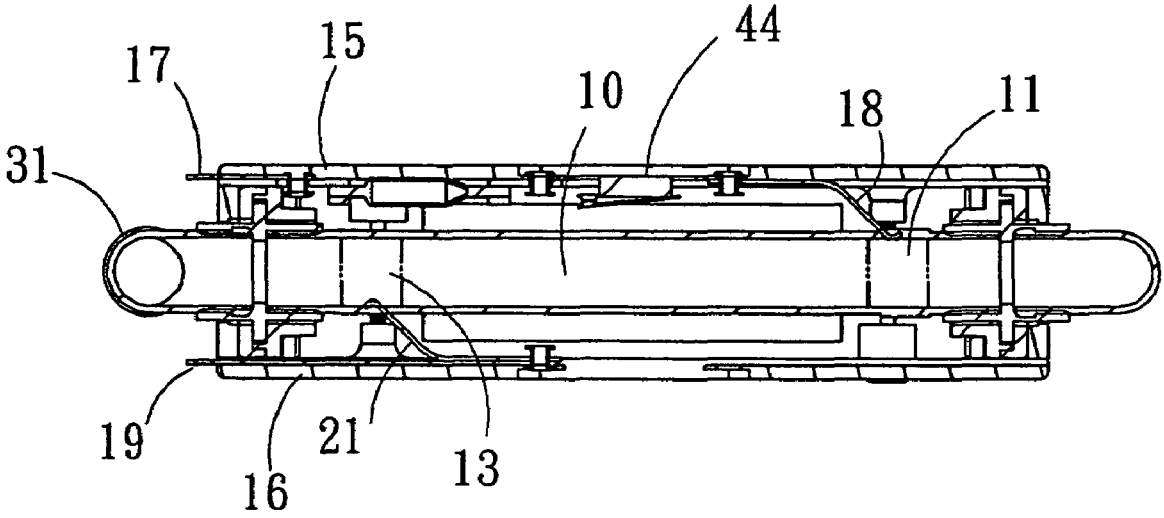
FIG. 1 is a cross sectional view of the present invention.
Figure 2:
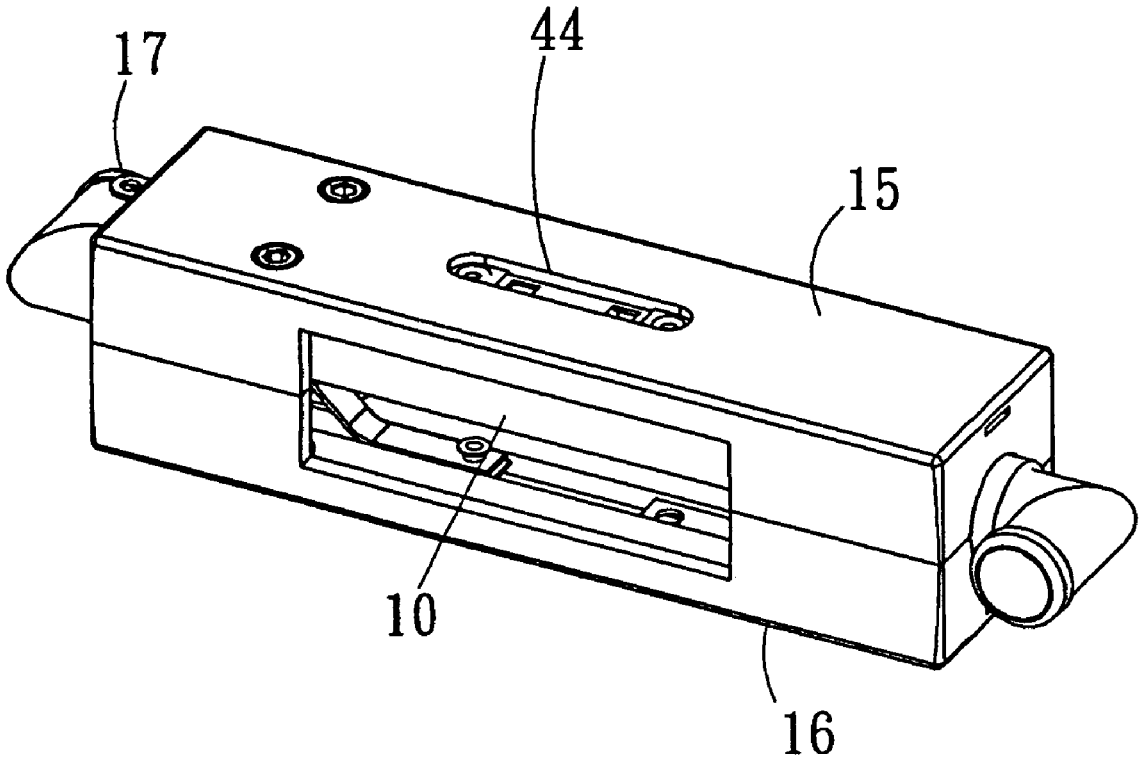
FIG. 2 is a perspective view of the present invention.

Referring to FIG. 1 through FIG. 4, the quartz heater tube of the present invention comprises a tube proper 10 with an electric heater film coated on its surface, and an electrode 11 (13) is respectively formed on each of the two terminals of the electric heater film such that the tube proper 10 is heated by applying a voltage between the electrodes 11 and 13.

The quartz heater tube proper 10 is covered with a first and a second coverings 15 and 16 on its outer surface. The first covering 15 has a first strip type electrode 17 with one end projected out of the first covering 15; while the other end thereof is provided with a metal spring leaf 18, and the spring leaf 18 is connected to the electrode 11 of the tube proper 10 so that the first strip type electrode 17 is electrically in connection with the electrode 11. Similarly, the second covering 16 has a second strip type electrode 19 with one end projected out of the second covering 16; while the other end thereof is provided with a metal spring leaf 21, and the spring leaf 21 is connected to the electrode 13 of the tube body 10 so that the second strip type electrode 19 is electrically in connection with the electrode 13.

With such a scheme, the quartz heater tube proper 10 is securely protected by the first and second coverings 15, 16 not to be destroyed with an external impact. Besides, a plurality of tube propers 10 can be connected in series or parallel by adaptive sleeves 31 bridged across the terminals of the adjacent tube propers 10 so as to form an impact resistant quartz heater tube module qualified for the production test.

Figure 3:
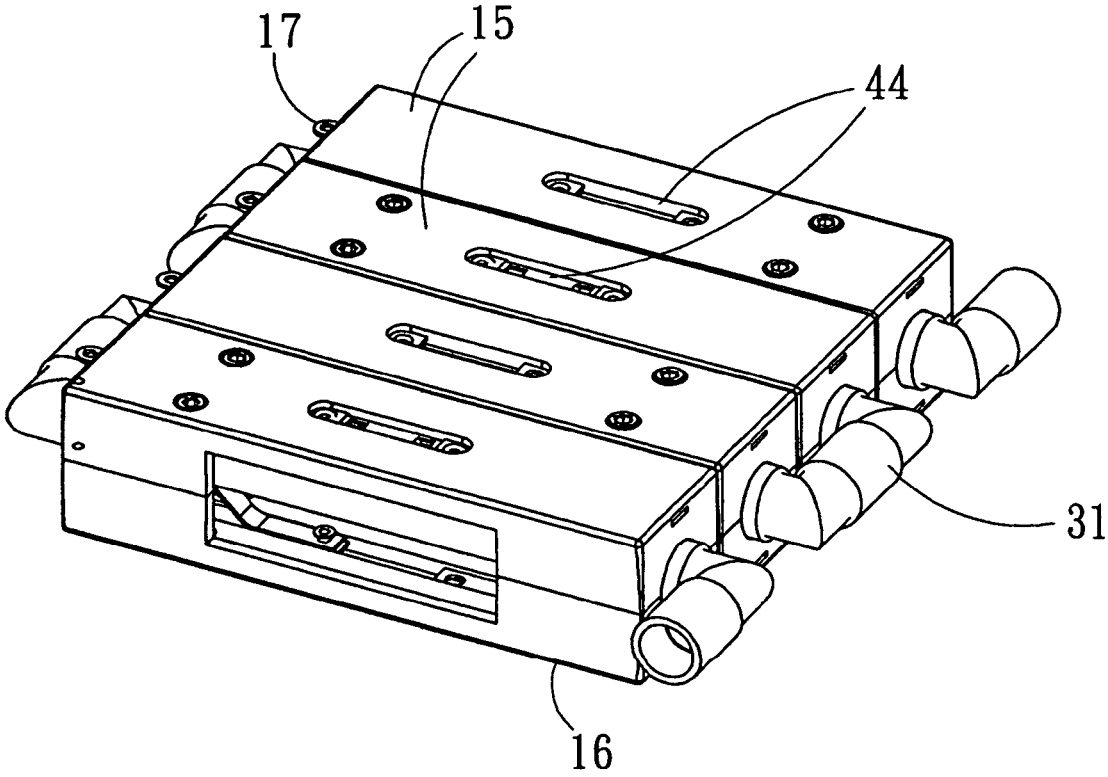
FIG. 3 is an assembly view of the present invention.
Figure 4:
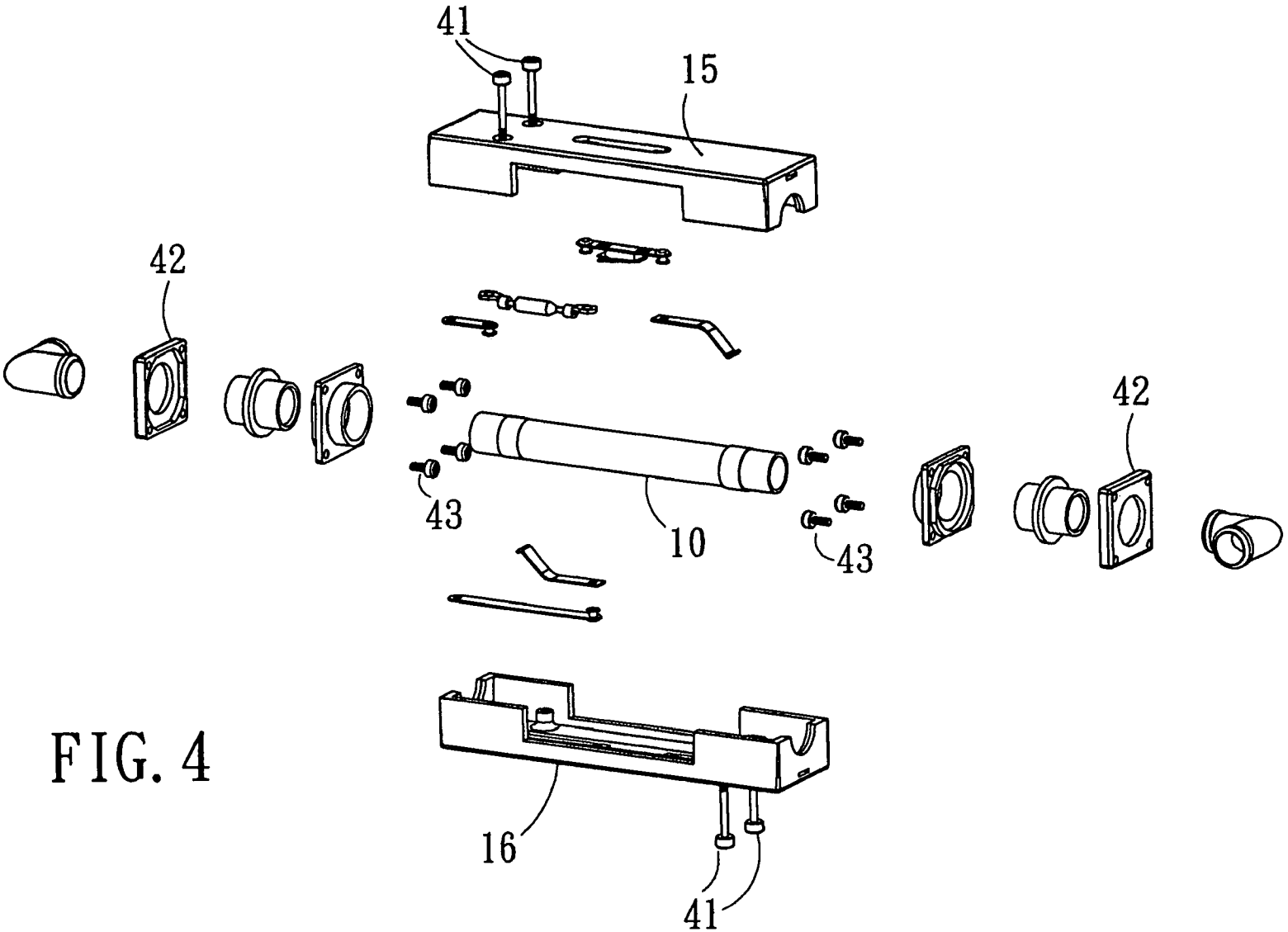
FIG. 4 is an exploded illustrative view for an individual quartz heater tube according to the present invention.

As shown in FIG. 3, the adaptive sleeve may be formed into straight or L shape convenient to connect several tube propers 10 in series or parallel electrically to form a quartz heater tube module.

Referring to FIG. 4 again, the first and second coverings 15 and 16 are engaged together by screws 41 to cover on the tube proper 10. A protective cap 42 is engaged to each of the two terminals of the tube body 10 by screws 43.

Referring again to FIG. 1 through FIG. 3, the first strip type electrode 11 is provided with an over temperature protector 44 which is used to interrupt supply current to the tube proper 10 in case it is over heated.

The present invention is a high level technical creation and not simply utilizes conventional technology or knowledge known prior to the application for patent or can easily be made by persons skilled in the arts. Prior to the application for patent, the invention has neither been published or put to public use, nor displayed in an exhibition, therefore the present invention is eligible for applying patent.

Other embodiments of the present invention will become obvious to those skilled in the arts in light of the above disclosure. It is of course also understood that the scope of the present invention is not to be determined by the foregoing description, but only by the following claims.

What is claimed is:

1. A quartz heater tube module comprising:

a plurality of quartz heater tube propers and each of said heated tube propers having an outer surface, and an electric heater film coated on said outer surface, and said electric heater film having two ends and a pair of electrodes with one of said electrodes on each of the two ends thereof for heating said heater tube proper by applying a voltage between said electrodes;

a first and a second covering on said outer surface of said heater tube proper;

a first strip type electrode formed on said first covering and projecting outwardly from one end thereof, a metal spring leaf connected with one of said two electrodes of said tube proper to thereby connect said first strip type electrode with said electrode of said heater tube proper electrically;

a second strip type electrode formed on said second covering and projecting outwardly from one end thereof, and a metal spring leaf connected with the other electrode of said heater tube proper to thereby connect said second strip type electrode with the other electrode of said heater tube proper electrically; and an adaptive sleeve disposed on each end of said quartz heater tube proper for connecting each of said heater tube propers to an adjacent heater tube proper;

whereby said quartz heater tube proper is protected from breaking by an external impact force by said first and second covering, and a plurality of tube propers can be connected to form said quartz heater tube module using said adaptive sleeves to bridge the adjacent heater tube propers.

2. The quartz heater tube module of claim 1, wherein said adaptive sleeve defines a straight shape.

3. The quartz heater tube module of claim 1, wherein said adaptive sleeve defines a L shape.

4. The quartz heater tube module of claim 1, wherein said first and said second coverings are held together by screws.

5. The quartz heater tube module of claim 1, wherein said first strip type electrode is provided with an over temperature protector for interruption of the supply current to said tube proper in case of over heating.

* * * * *